US006427280B1

(12) United States Patent
Specht

(10) Patent No.: US 6,427,280 B1
(45) Date of Patent: Aug. 6, 2002

(54) CLEANING IMPLEMENT

(75) Inventor: Paul B. Specht, Wilmette, IL (US)

(73) Assignee: Freudenberg Household Products, River Grove, IL (US)

( * ) Notice: Subject to any disclaimer, the term of this patent is extended or adjusted under 35 U.S.C. 154(b) by 0 days.

(21) Appl. No.: 09/517,717

(22) Filed: Mar. 2, 2000

(51) Int. Cl.[7] ..... A47L 13/142
(52) U.S. Cl. ..... 15/120.2; 15/119.1; 15/120.1
(58) Field of Search ..... 15/116.1, 119.1, 15/120.1, 120.2

(56) References Cited

U.S. PATENT DOCUMENTS

| | | | | | |
|---|---|---|---|---|---|
| 135,400 | A | * | 2/1873 | Boyden | 15/120.2 |
| 1,709,622 | A | * | 4/1929 | Justis | 15/120.2 |
| 3,364,512 | A | * | 1/1968 | Yamashita et al. | 15/119.1 X |
| 3,462,788 | A | * | 8/1969 | Abbott | 15/119.1 |
| 4,561,141 | A | | 12/1985 | Trisolini | 15/3 |
| 4,642,832 | A | | 2/1987 | Trisolini | 15/3 |
| 5,675,857 | A | * | 10/1997 | Hirse | 15/119.1 |
| 5,675,858 | A | * | 10/1997 | Von Meyer | 15/119.1 |
| 5,976,266 | A | * | 11/1999 | Anderson et al. | 15/119.1 X |
| 6,108,848 | A | * | 8/2000 | Monahan | 15/119.1 |

FOREIGN PATENT DOCUMENTS

| | | | | |
|---|---|---|---|---|
| DE | 1952 440 | | 4/1970 | |
| DE | 3607121 | * | 9/1987 | 15/119.1 |
| EP | 0 119 964 A1 | | 9/1984 | |
| EP | 0 162 815 A1 | | 11/1985 | |
| EP | 0 752 230 A2 | | 1/1997 | |
| FR | 848688 | * | 11/1939 | 15/120.2 |
| FR | 2622785 | * | 5/1989 | 15/120.1 |
| GB | 45684 | * | 9/1935 | 15/120.2 |
| GB | 1 287 885 | | 9/1972 | |
| GB | 1300709 | * | 12/1972 | 15/120.2 |
| IT | 558295 | * | 7/1958 | 15/120.2 |
| IT | 584319 | * | 10/1958 | 15/120.2 |
| WO | 95/07046 | | 3/1995 | |
| WO | 97/24973 | | 7/1997 | |
| WO | 99/23930 | | 5/1999 | |

* cited by examiner

*Primary Examiner*—Mark Spisich
(74) *Attorney, Agent, or Firm*—Leydig, Voit & Mayer Ltd

(57) ABSTRACT

Disclosed is a cleaning implement in the form of a sleeve-type self-wringing mop. In accordance with a preferred embodiment of the invention, the cleaning implement includes a shaft, a mop of a liquid absorbent material disposed at one end, and a wringer. The wringer includes a wringing sleeve that comprises a handle that is rotatably relative to the sleeve over at least a portion of the axial range of travel of the sleeve, and at least one volute. The volute has a generally helicoid surface that cooperates with a drive that is fixed with respect to the shaft, the volute and drive cooperating in the manner of a cam and cam follower. A user may advance the wringer upon grasping the handle and axially translating the handle relative to the shaft. The camming interaction between the volute and drive causes rotation of the wringing sleeve relative to the shaft to cause liquid to be expelled from the mop.

16 Claims, 13 Drawing Sheets

CLEANING IMPLEMENT

TECHNICAL FIELD OF THE INVENTION

The invention is in the field of cleaning implements, and more particularly is in the field of self-wringing cleaning implements, commonly referred to as "self-wringing mops."

BACKGROUND OF THE INVENTION

A wide variety of cleaning implements are known in the art, and the prior art has provided numerous sweepers, brooms, mops, and the like. In recent years, one trend in the cleaning implement industry has been towards "self-wringing" cleaning implements or mops, the term "self-wringing" signifying that water or cleaning fluids may be wrung from the cleaning implement without the aid of a separate wringer bucket or other wringing device. In this respect, the prior art has provided numerous sponge mops, roller mops, twist mops (the term "twist mop" is a generic term for a certain type of self-wringing mop), and the like.

The art also provided numerous sleeve-type mops, in which the cleaning implement is provided with a wringing sleeve that travels axially with respect to the shaft of the cleaning implement. A mop composed of liquid-absorbent strings or strips or the like is disposed at one end of the shaft, and a user may move the sleeve to a position in which the mop is compressed within the sleeve to expel liquid therefrom. Although the prior art has provided numerous such cleaning implements, not all such implements are entirely satisfactory in performance. A principal drawback with many known sleeve-type mops is that it is difficult to completely expel liquid from the mop during the wringing operation. Another drawback is that such mops can be difficult to operate. The present invention is addressed towards overcoming these drawbacks.

THE INVENTION

In its broadest sense, the invention contemplates a cleaning implement that includes a shaft, a mop that comprises a plurality of liquid absorbent members, such as strings, disposed at one end of the shaft, and a wringing sleeve. The wringing sleeve is moveable axially with respect to the shaft and is rotatable relative thereto.

In accordance with a first preferred embodiment of the invention, the wringing sleeve forms a part of a wringer that generally comprises the wringing sleeve and an operator gripping handle that is connected to the sleeve. The wringing sleeve is movable over a range of travel between a mopping position and a range of wringing positions, in which wringing positions the wringing sleeve covers and compresses at least a portion of the mop to thereby expel liquid from the mop. The operator gripping handle is rotatable relative to the wringing sleeve through at least a portion of the axial range of travel.

In accordance with a second preferred embodiment of the invention, the cleaning implement includes a shaft, a mop disposed at one end of the shaft, and a wringing sleeve that includes a volute which includes a generally helicoid surface. The volute assists the sleeve in twisting the mop strings or strips about the shaft to thereby assist in expelling liquid. Most preferably, the shaft includes a drive that is mounted in a fixed position with respect to the shaft, wherein the helicoid surface of the volute defines a cam profile for the drive. Upon camming interaction of the drive with the helicoid surface, the wringing sleeve is biased to rotate relative to the shaft to thereby cause liquid to be expelled from the mop. The first and second preferred embodiments are not mutually exclusive and, to the contrary, the cleaning implement preferably embodies both of the foregoing preferred embodiments.

In accordance with a highly preferred embodiment of the invention, the cleaning implement includes a wringer with an operator gripping handle and a wringing sleeve with a volute and associated shaft drive as described above, and further includes a coupler that is interposed between the handle and the wringing sleeve. The coupler is rotatably coupled to either the handle or the wringing sleeve, and the coupler further releasably rotatably couples with the other one of the handle and the wringing sleeve. At the commencement of the wringing operation, the operator may grasp the operator gripping handle and move the operator gripping handle relative to the shaft. The camming interaction between the drive and the volutes of the wringing sleeve biases the wringing sleeve to rotate relative to the shaft to thereby wring liquid from that portion of the mop that is covered by and compressed within the sleeve. During this portion of the wringing operation, the handle is not coupled to the wringing sleeve, and thus the user need only manually translate the handle axially with respect to the sleeve to cause the sleeve to rotate. The handle will not rotate with respect to the shaft, so that the operator thus will not need to manually rotate the operator gripping handle. Subsequently in the wringing operation, after the drive has cleared the volute, the operator gripping handle couples with the wringing sleeve such that the handle and sleeve will rotate as a unit. The user may exert a final wringing force on the mop and thereby expel even further liquid from the mop, without needing to release the handle.

Further features of the preferred embodiments of the invention are described here and below and in the accompanying drawings. In the following description, reference is sometimes made to the "top," "bottom," or other regions of the cleaning implement. It should be understood that these terms are used solely for convenient reference, inasmuch as the cleaning implement may be used omnidirectionally.

DESCRIPTION OF THE PREFERRED EMBODIMENTS

Figure 1:
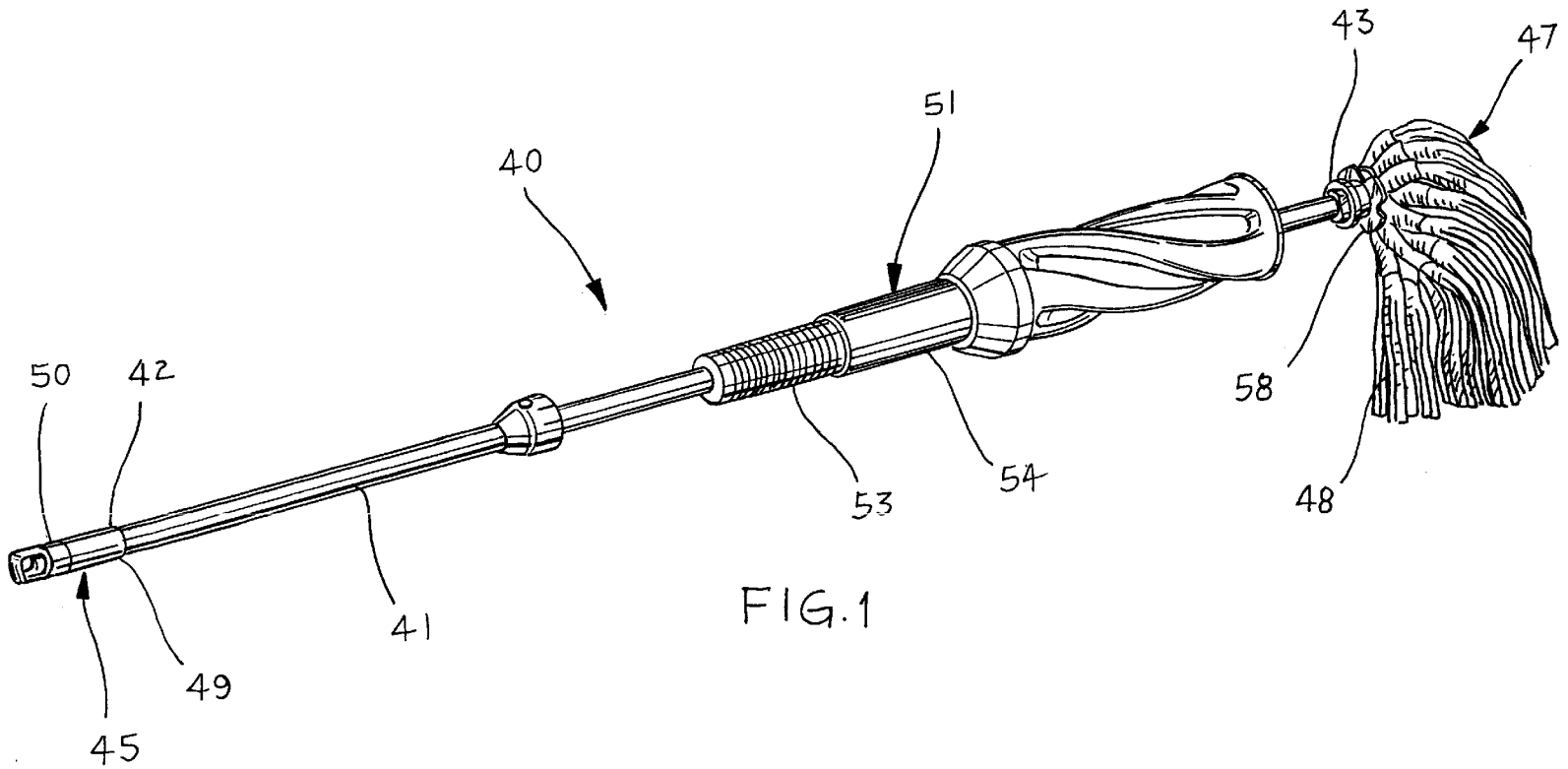
FIG. 1 is a perspective view of one embodiment of the cleaning implement of the invention.

The cleaning implement 40 of the preferred embodiment of the invention is shown generally in FIG. 1 as comprising a shaft 41 having an operator end 42 and a mopping end 43. A hanger cap 45 is disposed at the operator end 42 of the shaft 41, and a mop assembly 47 that includes a mop 48 is disposed at the mopping end 43. The mop 48 may be made of any suitable liquid absorbent material such as fabric strips, strings, or the like, and in the preferred embodiment is composed of composite fabric strips. The hanger cap 45 in the illustrated embodiment is a two-part cap in which one part 49 is fixed with respect to the shaft and the other part 50 is rotatable with respect to the shaft.

The mop further includes a wringing assembly or wringer 51, the wringer including an operator gripping handle 53 and a wringing sleeve 54, the handle 53 being disposed relatively proximal the operator end 42 of the shaft 41. The wringer is axially moveable with respect to the shaft over a range of travel between a fully retracted mopping position and a range of wringing positions (in FIG. 1, an intermediate position is depicted).

Figure 2:
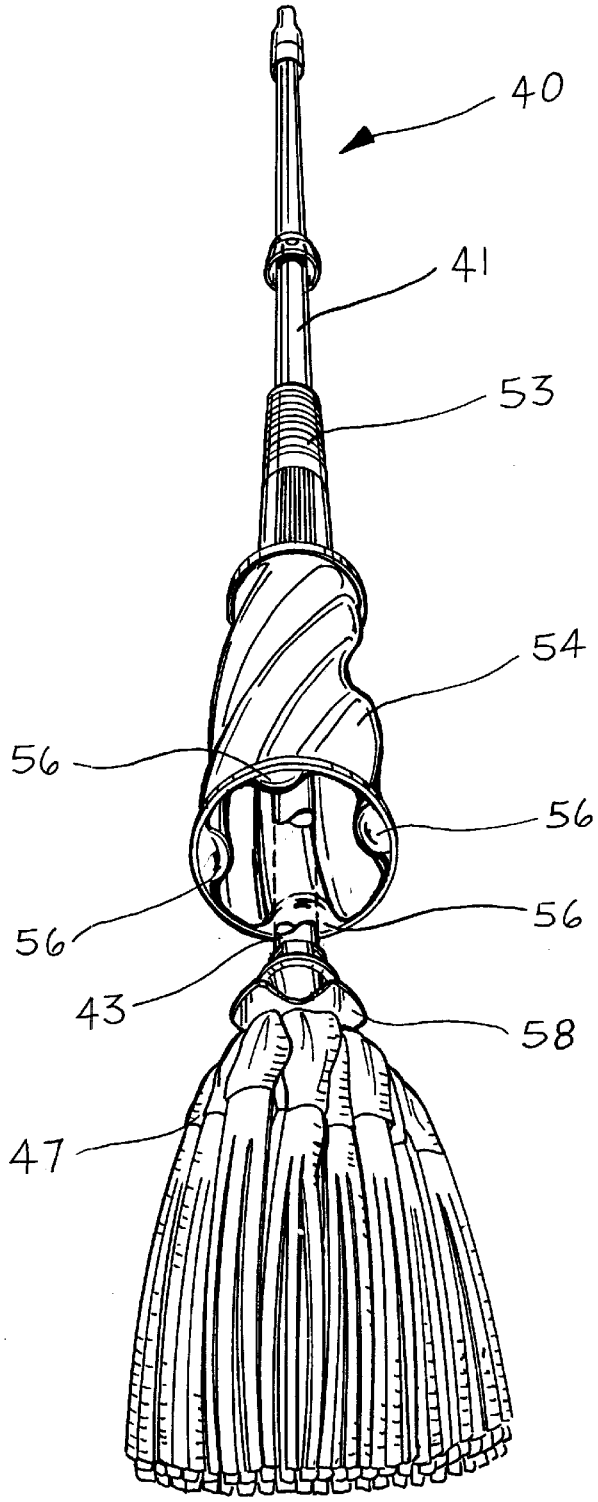
FIG. 2 is a front perspective view of the cleaning implement illustrated in FIG. 1.
Figure 3:
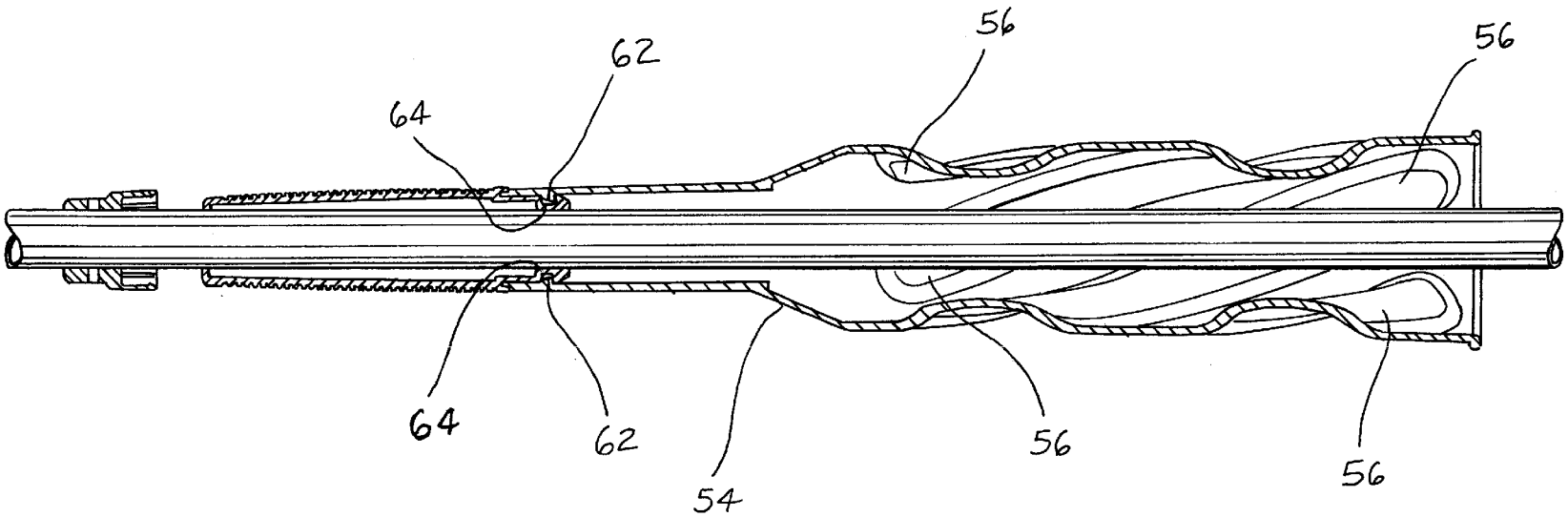
FIG. 3 is a side elevation, partially cut-away, of the cleaning implement illustrated in FIG. 1.

The construction of the wringing sleeve is shown in more detail in FIGS. 2 and 3. As shown, the wringing sleeve is provided with at least one volute, and preferably four volutes 56, as illustrated in FIG. 2. The volutes 56 are formed by portions of the interior surface of the wringing sleeve 54 that protrude generally radially inwardly. Each volute includes a surface that is generally helicoid, that is, a point axially traversing the surface tends generally to rotate about the axis of the wringing sleeve 54. In accordance with this aspect of the invention, the cleaning implement 40 is provided with a drive 58 (shown in FIGS. 1 and 2) disposed proximal the mopping end 43 of the shaft 41. In the illustrated embodiment, the drive 58 is a four-membered drive that is formed by a portion of the mop assembly 47 as discussed in more detail below, but other configurations are possible. The drive 58 is fixed with respect to the shaft 41.

Figure 4:
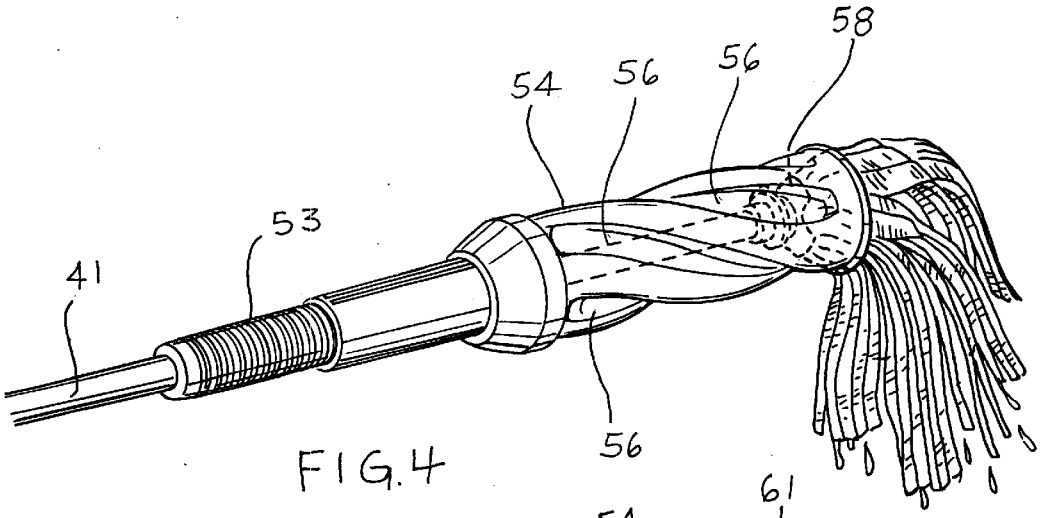
FIG. 4 is a perspective view of a portion of the cleaning implement shown in FIG. 1 at the commencement of the wringing operation, showing in hidden lines the shaft and the drive.
Figure 5:
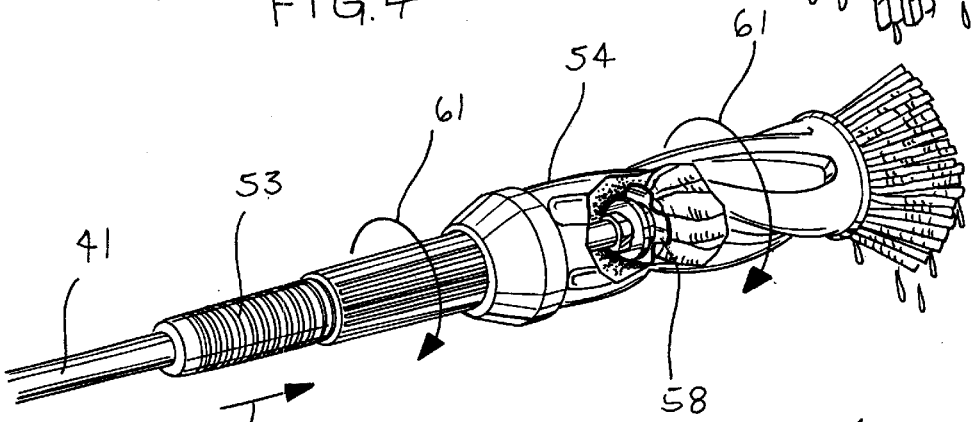
FIG. 5 is a perspective view, partially cut-away, of the cleaning implement shown in FIG. 4 at a point further along in the wringing operation.

As shown in FIGS. 4–7, the generally helicoid surfaces of the wringing sleeve volutes define a cam profile for the drive, that is, upon axial translation of the wringing sleeve relative to the shaft to cause camming engagement of the volute surfaces with the drive members of the drive 58, the wringing sleeve is biased to rotate relative to the shaft. For example, FIG. 4 illustrates the commencement of the wringing operation. As illustrated, the drive 58 has just begun to engage the volutes 56. As the wringing sleeve is advanced, i.e., translated in the direction of arrow 60 relative to the shaft as shown in FIG. 5, the wringing sleeve and drive co-act in the manner of a cam and cam follower to cause the wringing sleeve to rotate in the direction of arrows 61 with respect to the shaft 41.

Preferably, the wringing sleeve 54 includes a retaining ring 62 (shown in FIG. 3), and the operator gripping handle includes a notch 64 (also shown in FIG. 3) that cooperates with the retaining ring 62 to allow relative rotation of the handle and sleeve. Thus, with further reference to FIG. 5 a user may grasp the operator gripping handle 53 and may manually translate the operator gripping handle axially with respect to the shaft 41. The camming interaction of the wringing sleeve and drive biases the wringing sleeve 54 to rotate with respect to the shaft 41 such that the wringing sleeve compresses the portion of the mop that is covered by the sleeve. The handle does not rotate with respect to the shaft, and thus the user may continue to advance the wringer and to increase the degree of rotation of the wringing sleeve relative to the shaft without needing to rotate the operator gripping handle itself.

Figure 6:
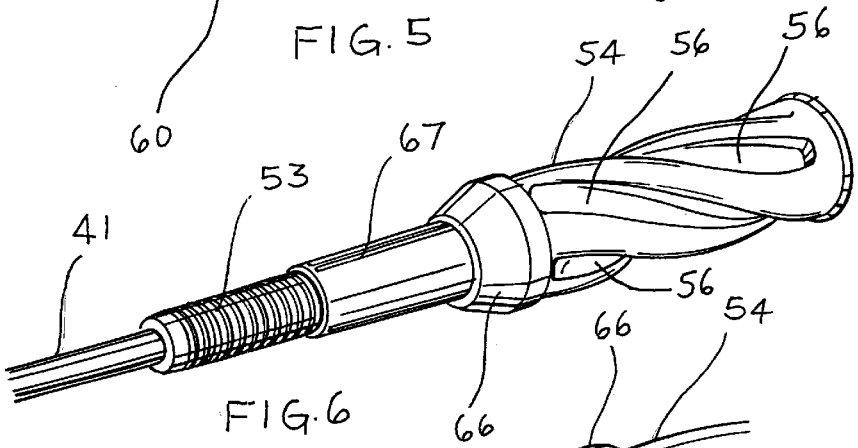
FIG. 6 is a perspective view of the mop shown in FIGS. 4 and 5 near the conclusion of the wringing operation.
Figure 7:
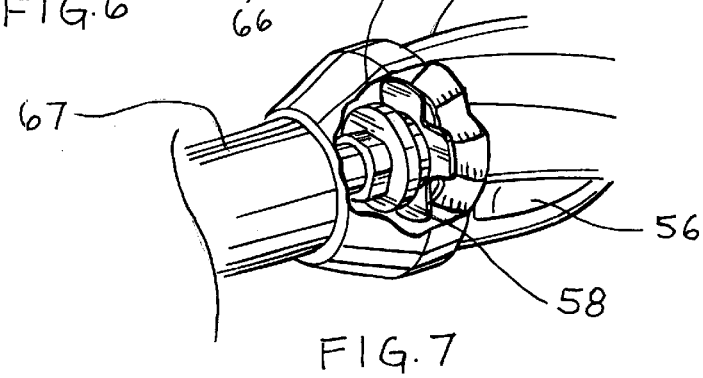
FIG. 7 is an enlarged partially cut-away view of a portion of the cleaning implement shown in FIG. 6.

The axially terminal position of the wringing sleeve is shown in FIG. 6 and FIG. 7. Preferably, the wringing sleeve is of sufficient length such that the mop is entirely drawn into the sleeve for compression therewithin by the time the wringing sleeve has been advanced to this position. The wringing sleeve preferably includes a free drive volume 66 proximal the volutes 56. As shown in FIG. 7, the free drive volume 66 is sized to accommodate non-interfering relative rotation of the drive 58 and wringing sleeve 54. Thus, if the user determines that insufficient liquid has been expelled from the mop, the user may grasp the wringing sleeve in the area of region 67 (shown in FIGS. 6 and 7) to continue to rotate the wringing sleeve relative to the shaft to thereby expel further liquid from the mop.

Figure 9:
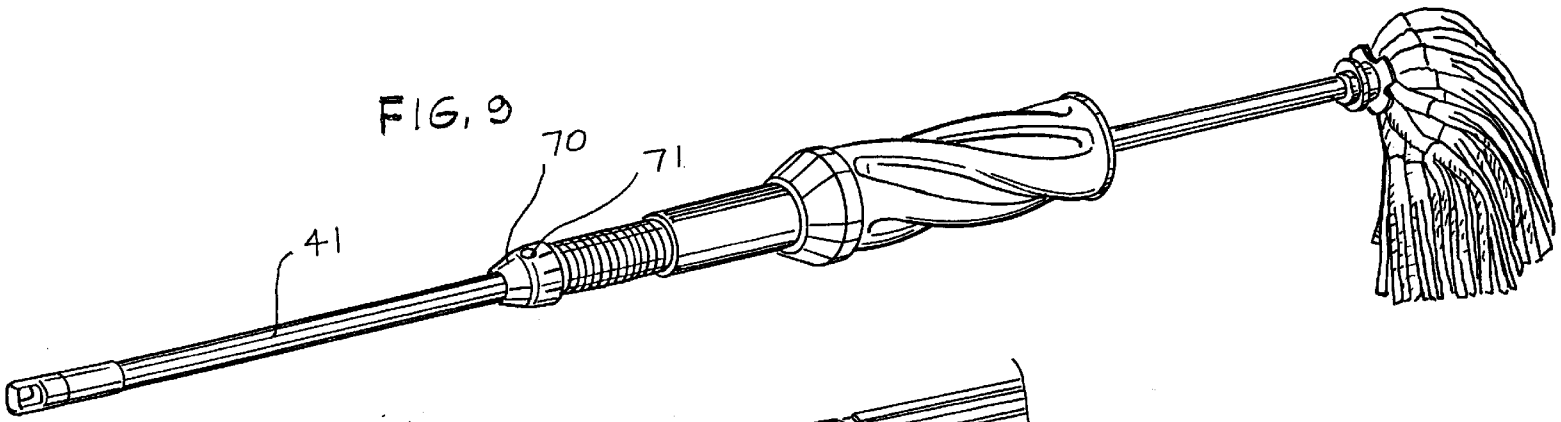
FIG. 9 is a perspective view of the cleaning implement shown in FIG. 1, the cleaning implement depicted when the wringer is in a fully retracted mopping position.
Figure 10:
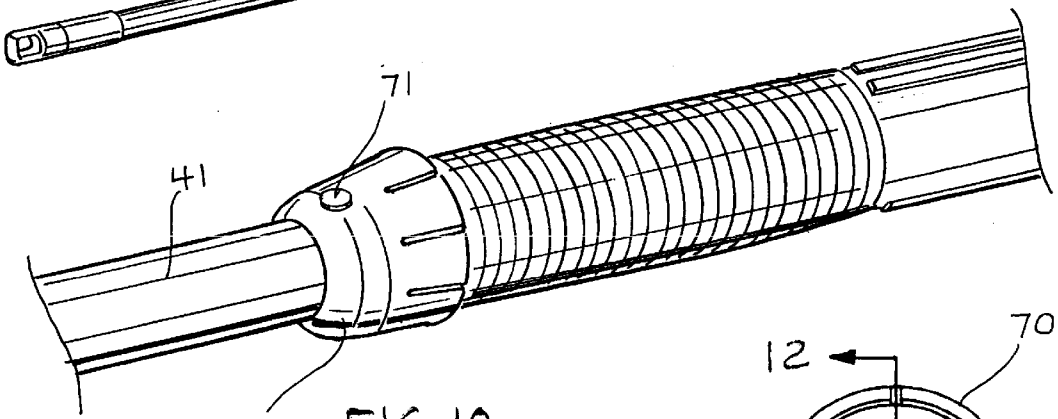
FIG. 10 is an enlarged perspective view of the cleaning implement shown in FIG. 9.
Figure 11:
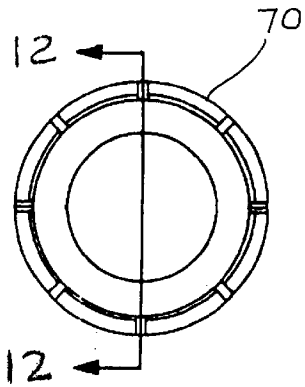
FIG. 11 is a bottom view of the retainer shown in FIGS. 9 and 10.
Figure 12:
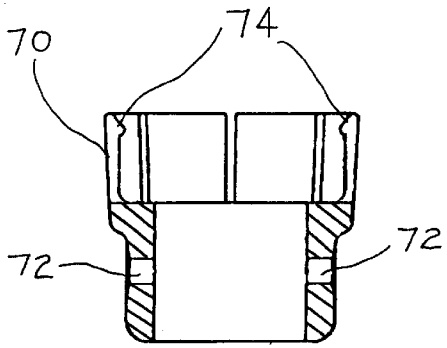
FIG. 12 is a cross-sectional view taken along line 12—12 in FIG. 11.
Figure 24:
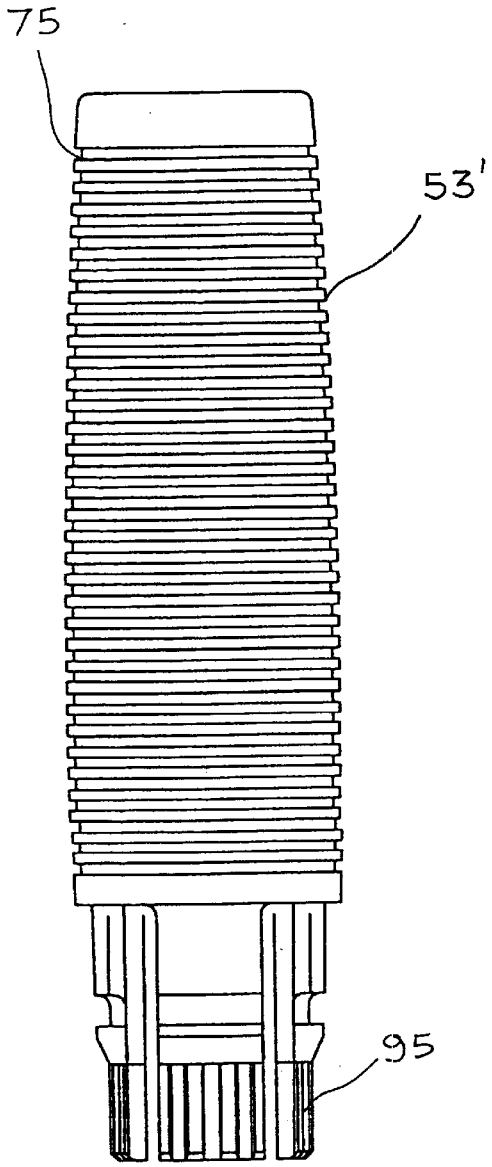
FIG. 24 is a front elevation of an alternative embodiment of the operator gripping handle.

FIGS. 9 and 10 depict the wringer in its fully retracted mopping position. The mop includes a retainer 70 which is secured to the shaft via a pin 71. The retainer is further shown in FIGS. 11 and 12. As shown in FIG. 12, the wringer includes a bore 72 for the pin 71, the bore registering with an accompanying shaft bore (not shown). The retainer further includes a retaining ring 74 that cooperates with a notch on the handle (comparable to notch 75 on handle 53' in FIG. 24) to releasably axially retain the wringer in the fully retracted mopping position.

Figure 8:
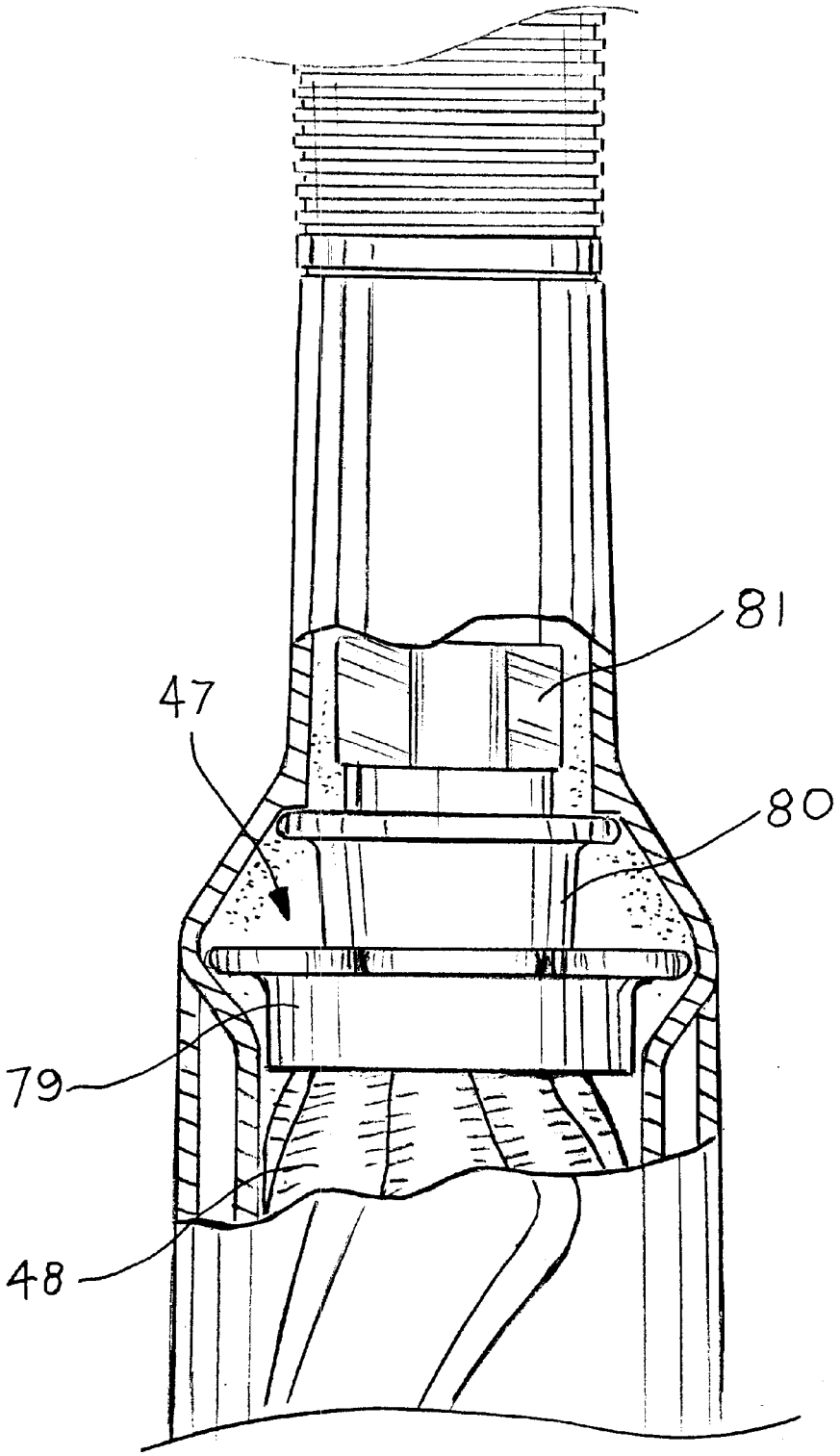
FIG. 8 is an enlarged front elevation, partially cut-away, of the cleaning implement shown in FIGS. 6 and 7.
Figure 13:
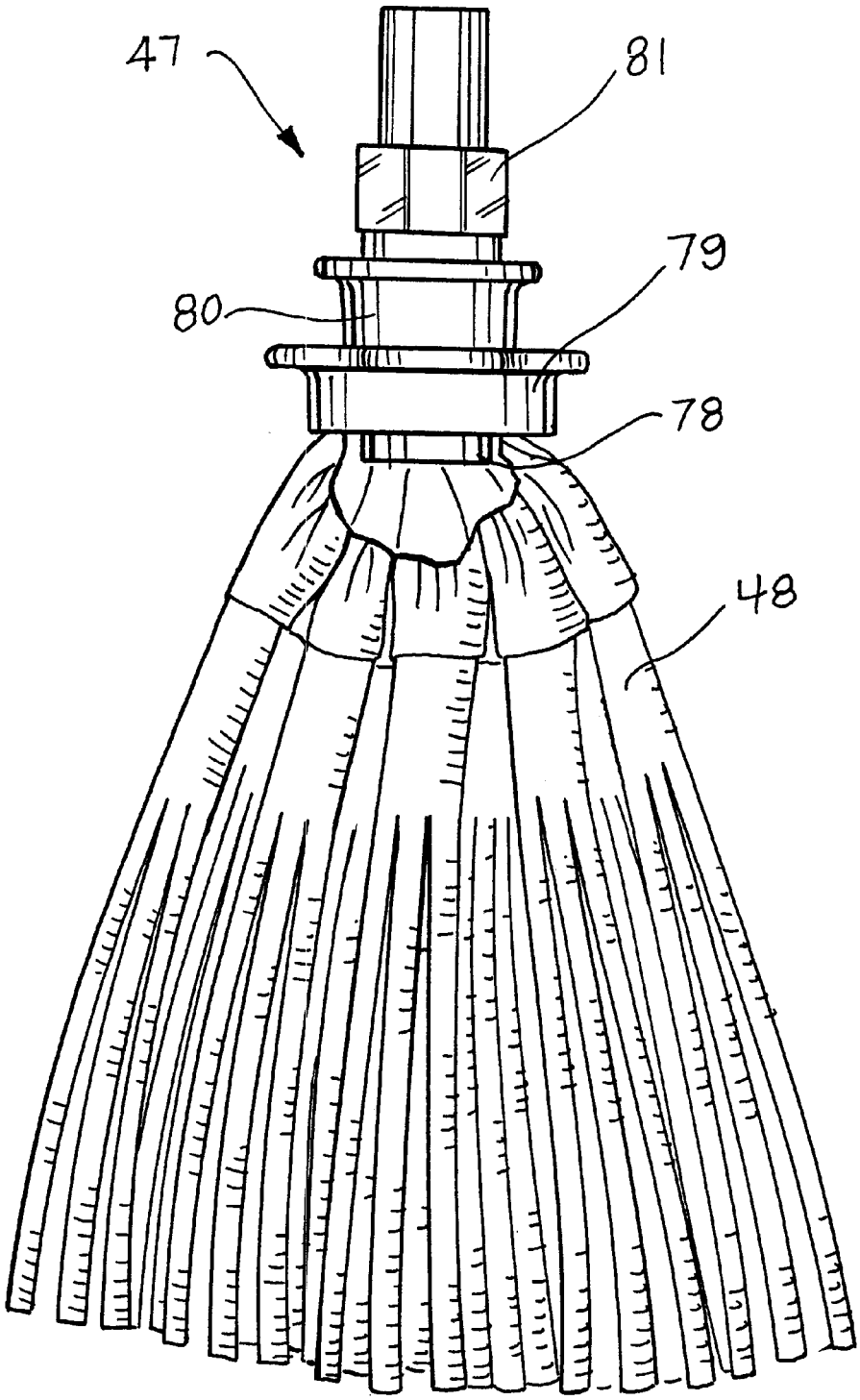
FIG. 13 is a front elevation, partially cut-away, of the mop assembly of the mop shown in FIG. 1, the FIG. depicting, inter alia, a mop assembly plug, a drive portion, a retaining collar, and a shaft socket.
Figure 14:
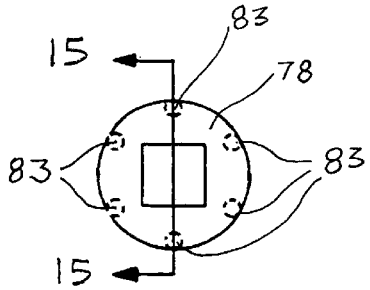
FIG. 14 is a bottom view of the mop assembly plug shown in FIG. 13.
Figure 15:
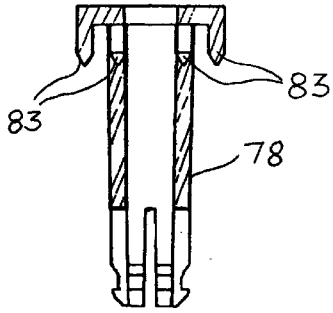
FIG. 15 is a cross-sectional view taken along line 15—15 in FIG. 14.
Figure 16:
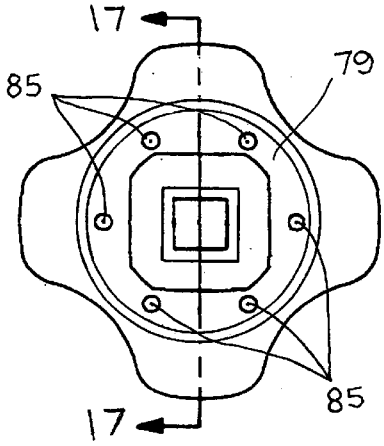
FIG. 16 is a bottom view of the drive portion of the mop assembly shown in FIG. 13.
Figure 17:
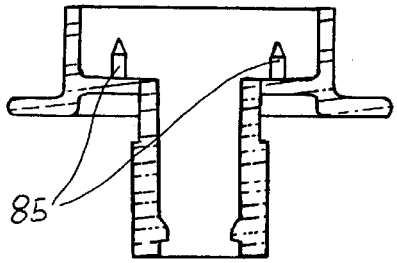
FIG. 17 is a cross-sectional view taken along line 17—17 in FIG. 16.
Figure 18:
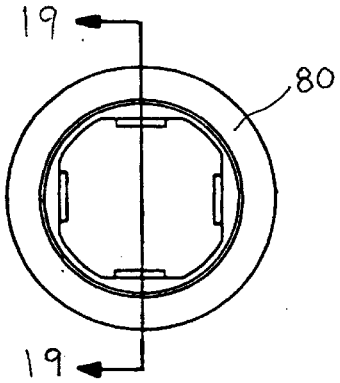
FIG. 18 is a bottom view of the retaining collar of the mop assembly shown in FIG. 13.
Figure 19:
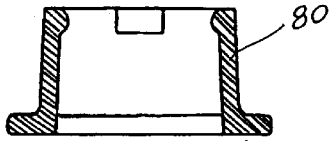
FIG. 19 is cross-sectional view taken along 19—19 in FIG. 18.
Figure 20:
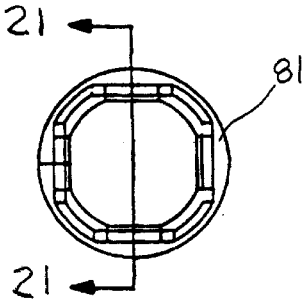
FIG. 20 is a bottom view of the shaft socket illustrated in FIG. 13.
Figure 21:
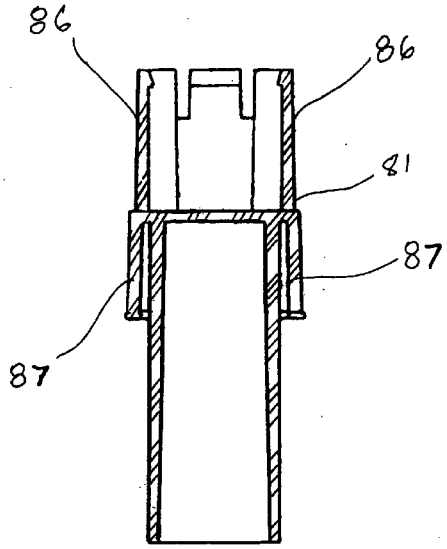
FIG. 21 is a cross-sectional view taken along line 21—21 in FIG. 20.
Figure 29:
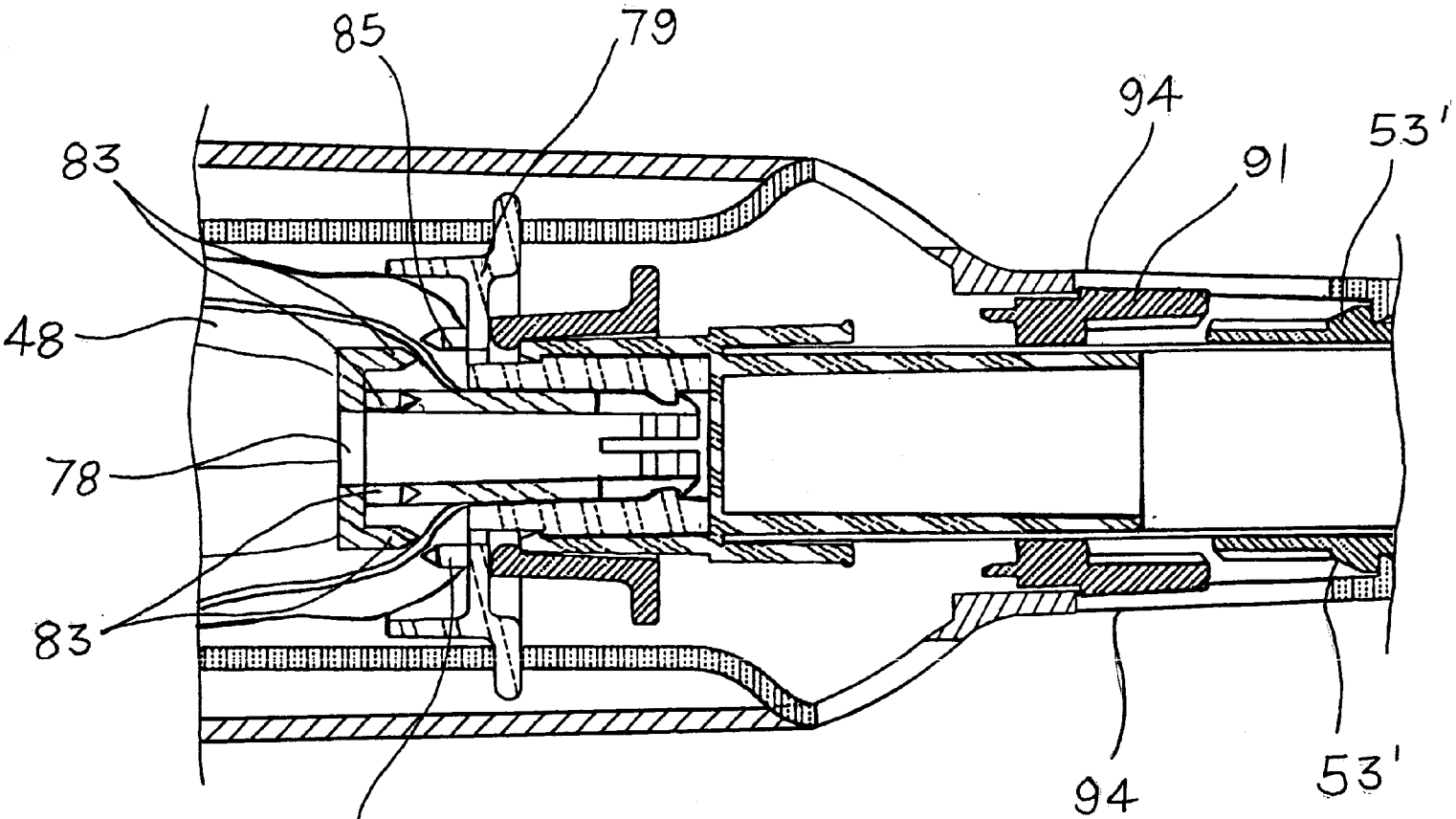
FIG. 29 is a cross-sectional view of a highly preferred embodiment of the cleaning implement of the invention, shown upon advancement of the wringer for wringing, the drive being interengaged with the volutes of the wringing sleeve.

The mop assembly 47 is shown in more detail in FIGS. 8 and 13. As illustrated, the mop assembly comprises the mop 48, a mop assembly plug 78 (not shown in FIG. 8), a drive portion 79, a retaining collar 80, and a shaft socket 81. As shown in more detail in FIGS. 14–17, the plug 78 is provided with a plurality of teeth 83 which, in conjunction with corresponding teeth 85 on the drive member 79, serve to secure the mop therebetween (as best shown in FIG. 29). The drive portion 79 is retained in a front socket portion 86 of the shaft socket 81 with the aid of the retaining collar 80, as shown in more detail in FIG. 30. The shaft socket 81 includes a rear socket portion 87 which receives the shaft 41 to retain the mop assembly in a fixed position with respect thereto. The shaft may have a crimp (not shown) to assist in frictionally retaining the shaft socket.

Figure 22:
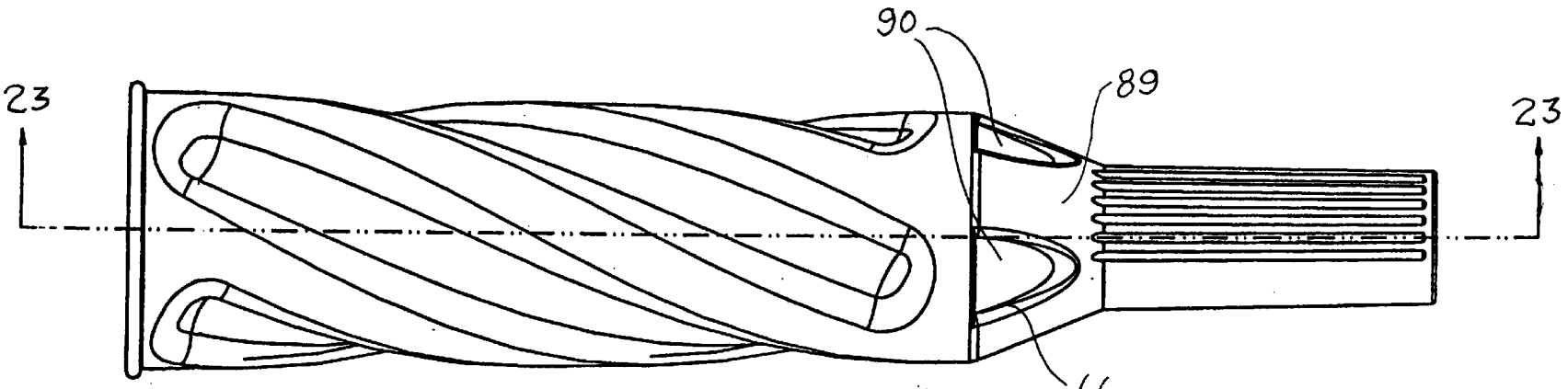
FIG. 22 is a side elevation of an alternative embodiment of the cleaning implement of the invention, specifically illustrating an alternative embodiment of the wringing sleeve.
Figure 23:
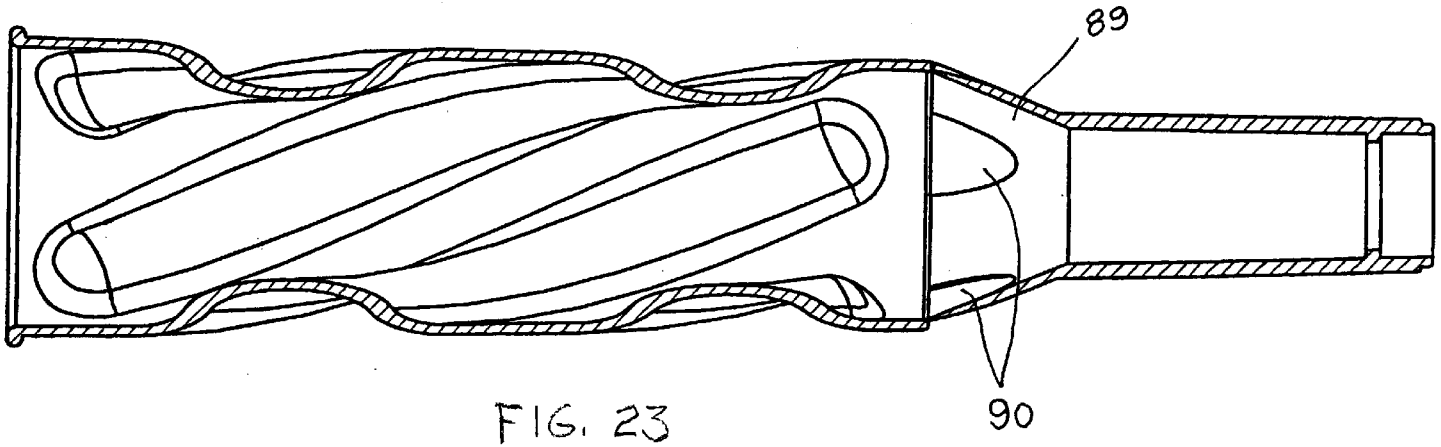
FIG. 23 is a cross-sectional view taken along line 23—23 in FIG. 22.

An alternative embodiment of the wringing sleeve is shown in FIGS. 22 and 23. The free drive volume 66 is defined by a surface 89 of the wringing sleeve. As shown, the surface defining the free drive volume may include an aperture, and preferably includes a plurality of apertures 90. The apertures are provided for ease of molding of the cleaning implement, and also to allow a liquid egress from the wringing sleeve.

Figure 25:
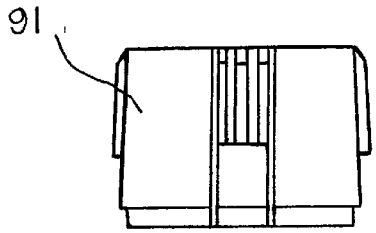
FIG. 25 is a front elevation of a coupler useful in conjunction with the handle shown in FIG. 25.
Figure 26:
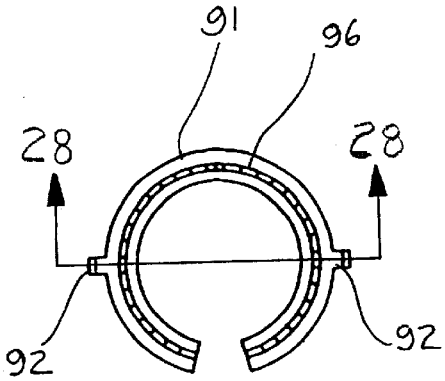
FIG. 26 is a top view of the coupler shown in FIG. 26.
Figure 28:
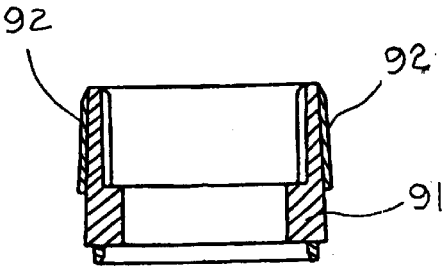
FIG. 28 is a cross-sectional view taken along line 28—28 in FIG. 26.
Figure 27:
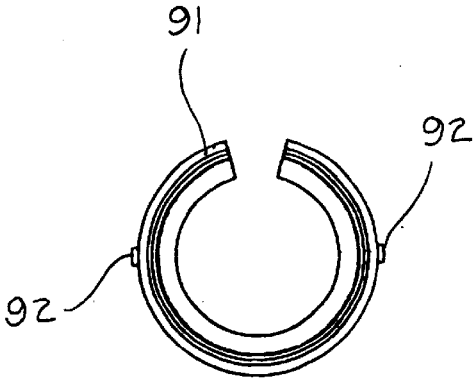
FIG. 27 is a bottom view of the coupler shown in FIG. 26.
Figure 30:
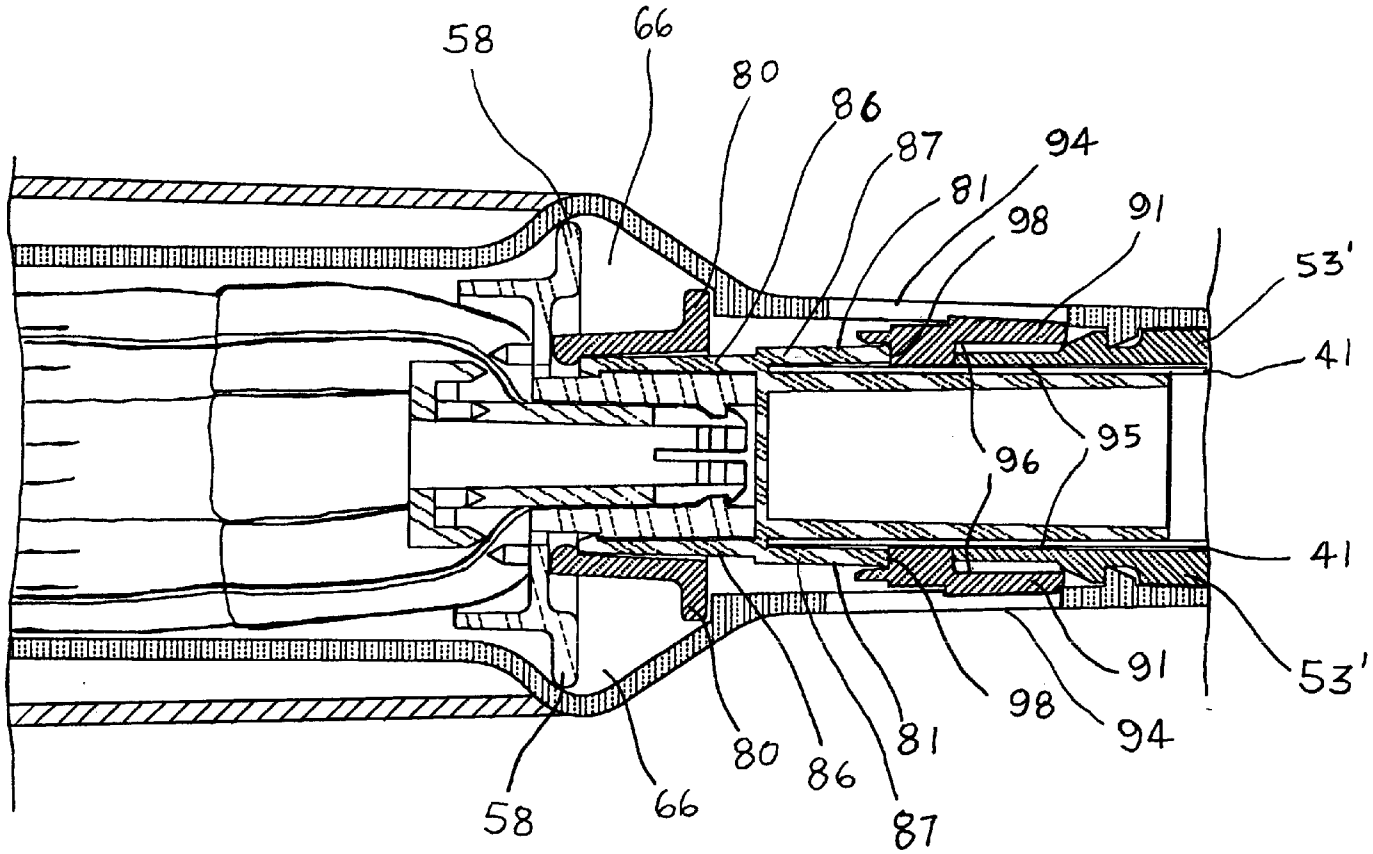
FIG. 30 is a cross-sectional view of the cleaning implement shown in FIG. 29, shown further along in the wringing operation with the handle and wringing sleeve in a coupled relationship.
Figure 31:
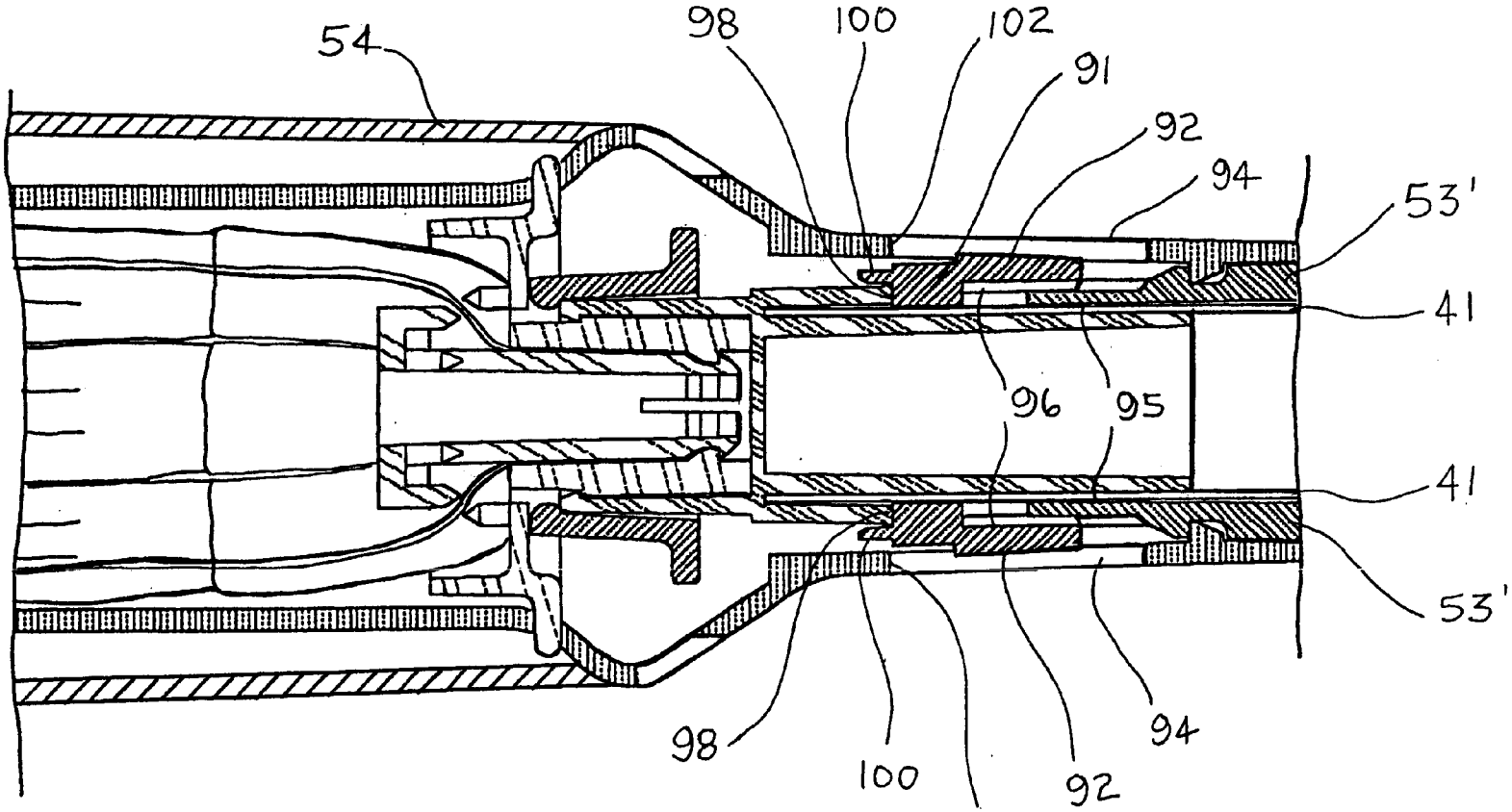
FIG. 31 is a cross-sectional view of the cleaning implement shown in FIGS. 29 and 30, showing the operation of retraction of the wringing sleeve after wringing.

In accordance with a highly preferred embodiment of the invention, the cleaning implement is provided with a coupler 91, as shown in FIGS. 25–28. The coupler is interposed between the handle and the wringing sleeve, and is rotatably coupled to one of the handle and the wringing sleeve. In operation, the coupler releasably rotatably couples with the other of the handle and the wringing sleeve. The coupler has an open section to allow for ready assembly of the mop. Most preferably, the coupler is rotatably coupled to the wringing sleeve by virtue of a keyed mechanism wherein the coupler includes one of a key and an axially oriented keyway, and the wringing sleeve is provided with the other of the key and the axially oriented keyway. Most preferably, the coupler includes two keys 92, as best shown in FIGS. 26–28, and the wringing sleeve includes two axially oriented keyways 94, as shown in FIGS. 29 to 31. The keyways register with the key and permit limited relative axial movement of the coupler and the wringing sleeve.

The purpose of the coupler is to allow releasable rotatable coupling of the handle and wringing sleeve. In carrying out this aspect of the invention, the handle 53' is provided with a splined plug 95, as shown in FIG. 25. The coupler is provided with a mating splined socket 96, as best shown in FIG. 26. When the coupler is translated axially with respect to the handle, the plug is introduced into the socket, and the coupler, wringing sleeve, and handle will rotate as a unit. In an alternative embodiment (not shown), the coupler may be provided with the splined plug, and the handle with the splined socket.

FIG. 29 illustrates the cleaning implement partially through a wringing operation. As shown, the coupler 91 is disengaged from the handle 53' up to this point in the wringing operation. When the wringer is advanced to its terminal position to place the drive 58 within the free drive volume 66 (as shown in FIG. 30), an abutting portion 98 on the shaft socket 81 biases the coupler 91 to cause axial translation of the coupler relative to the handle such that the splined plug 95 is introduced into the splined socket 96. Thus, should the user desire to expel further liquid from the mop, the user may cause rotation of the wringing sleeve by rotating the operator gripping handle, thereby exerting additional wringing force on the mop. Wringing of the mop and subsequent application of additional wringing pressure thus may be accomplished in one fluid motion by the user, without the user ever needing to release the operator gripping handle 53'.

FIG. 31 illustrates the operation of retraction of the wringer after wringing of the mop. As illustrated, the coupler 91 includes a keeper socket 100 that receives the abutting portion 98 to thereby temporarily axially couple the shaft to the coupler. As the wringer is retracted, the coupler 91 will remain stationary with respect to the shaft 41 but will translate axially away from the handle 53' to thereby rotatably decouple the coupler 91 and handle 53' via withdrawal of the splined plug 95 from the splined socket 96. The axial translation of the coupler 91 is accommodated by the wringing sleeve 54 via the axial orientation of the keyways 94. The range of axial travel of the coupler is limited by the stop ends 102 of the keyways 94, which limit the axial range of travel of the keys 92, thereby causing the shaft and coupler to axially decouple. Thus, when the wringing sleeve has been retracted a short distance, the handle and the wringer will rotatably decouple such that the operator may continue to retract the wringer to its fully retracted mopping position without ever letting go of the handle 53'.

The components of the cleaning implement may be manufactured and assembled via conventional techniques. The shaft is preferably fashioned of a hollow steel tube, and the other components (besides the mop) preferably are composed of metal or plastic, such as ABS and/or a high impact polymer.

It is thus seen that drawbacks of the known sleeve-type mops discussed above have been addressed. The cleaning implement of the invention allows a user to wring substantial amounts of liquid from the mop. The invention further allows the user to accomplish both wringing of the mop and retraction of the wringer to its fully retracted mopping position without the user ever needing to release the handle.

While particular embodiments of the invention have been shown, it will be understood that the invention is not limited thereto since modifications may be made by those skilled in the art, particularly in light of the foregoing teachings. For example, the wringing sleeve may contain a different number of volutes, or the volutes may have a non-helicoid surface in addition to the helicoid surfaces. It is, therefore, contemplated by the appended claims to cover any such modifications as incorporate those features which constitute the essential features of these improvements within the true spirit and scope of the invention.

What is claimed is:

1. A cleaning implement comprising:

a shaft having an operator end and a cleaning end;

a mop disposed at said cleaning end, said mop comprising a plurality of liquid absorbent members;

a wringer, said wringer comprising a wringing sleeve, said wringing sleeve being rotatable relative to said shaft, said wringer further comprising an operator gripping handle, said operator gripping handle being disposed relatively proximal said operator end of said shaft with respect to said wringing sleeve, said wringer being axially movable relative to said shaft over a range of travel between a mopping position and a range of wringing positions, said handle being rotatable relative to said wringing sleeve through at least a portion of said range of travel, said wringing sleeve in said wringing positions covering and compressing at least a portion of said mop whereby liquid is expellable from said mop.

2. A cleaning implement according to claim 1, wherein said wringer is axially movable relative to said shaft to a fully retracted mopping position, said cleaning implement including a retainer disposed on said shaft and being axially fixed with respect thereto, said retainer releasably axially retaining said wringer in said fully retracted mopping position.

3. A cleaning implement according to claim 1, said shaft including a drive mounted in a fixed position with respect to said shaft, said wringing sleeve including at least one volute, said volute including a generally helicoid surface that defines a cam profile for said drive, whereby upon camming interaction between said surface and said drive, said wringing sleeve is biased to rotate relative to said shaft.

4. A cleaning implement according to claim 3, said wringing sleeve including four volutes, said drive being a four-membered drive.

5. A cleaning implement according to claim 3, said wringing sleeve including a free drive volume proximal said volute.

6. A cleaning implement according to claim 5, said free drive volume being defined by a surface of said wringing sleeve, said surface including at least one aperture.

7. A cleaning implement according to claim 1, said cleaning implement including a coupler interposed between said handle and said wringing sleeve, said coupler being rotatably coupled to one of said handle and said wringing sleeve and releasably rotatably coupling with the other of said handle and said wringing sleeve.

8. A cleaning implement according to claim 7, wherein said coupler is rotatably coupled to said wringing sleeve, said coupler including one of a key and an axially oriented keyway, said wringing sleeve including the other of said key and said axially oriented keyway, said keyway registering with said key and permitting at least limited relative axial movement of said coupler and said wringing sleeve.

9. A cleaning implement according to claim 8, said coupler including one of a splined plug and a splined socket, said handle including the other of said splined plug and said splined socket, said handle releasably rotatably coupling with said coupler via engagement of said splined plug and said splined socket, said shaft including an abutting portion proximal said cleaning end, whereby, upon biasing of said abutting portion against said coupler to cause axial translation of said coupler towards said handle, said splined plug is axially introduced into said splined socket to thereby rotatably couple said coupler and said handle.

10. A cleaning implement according to claim 9, said coupler including a keeper socket receiving said abutting portion and axially coupling said shaft to said coupler, whereby retraction of said wringer causes axial translation of said coupler away from said handle, whereby said splined plug is axially withdrawn from said splined socket to thereby rotatably decouple said coupler and said handle.

11. A cleaning implement comprising:

a shaft having an operator end and a cleaning end, said shaft including a drive mounted in a fixed position with respect to said shaft;

a mop disposed at said cleaning end, said mop comprising a plurality of liquid absorbent members; and a wringing sleeve, said wringing sleeve being rotatable relative to said shaft, said wringing sleeve being axially movable over a range of travel between a mopping position and a range of wringing positions, said wringing sleeve in said wringing positions covering and compressing at least a portion of said mop whereby liquid is expellable from said mop, said wringing sleeve including at least one volute, said volute including a generally helicoid surface, said helicoid surface of said volute defining a cam profile for said drive, whereby upon camming interaction between said surface and said drive said wringing sleeve is biased to rotate relative to said shaft.

12. A cleaning implement according to claim 11, said wringing sleeve including a free drive volume proximal said volute.

13. A cleaning implement according to claim 12, said wringing sleeve having a surface that defines said free drive volume, said surface including at least one aperture.

14. A cleaning implement according to claim 11, wherein said wringing sleeve is axially movable relative to said shaft to a fully retracted mopping position, said cleaning implement including a retainer disposed on said shaft and being axially fixed with respect thereto, said retainer releasably axially retaining said wringing sleeve in said fully retracted mopping position.

15. A cleaning implement according to claim 14, wherein said wringing sleeve includes a notch, said retainer includes a retaining ring, said retaining ring cooperating with said notch of said wringing sleeve to releasably axially retain said wringing sleeve in said fully retracted mopping position.

16. A cleaning implement according to claim 11, said wringing sleeve including four volutes, said drive being a four-membered drive.

* * * * *